US006460821B1

(12) United States Patent
Rhudy et al.

(10) Patent No.: US 6,460,821 B1
(45) Date of Patent: Oct. 8, 2002

(54) DSS UNI-MOUNT

(76) Inventors: David Andrew Rhudy, 402 Liberty St., Gatesville, TX (US) 76528; James David Corpier, Rte. 1, Hillcrest Rd., Clifton, TX (US) 76634

( * ) Notice: Subject to any disclaimer, the term of this patent is extended or adjusted under 35 U.S.C. 154(b) by 0 days.

(21) Appl. No.: 09/716,256

(22) Filed: Nov. 20, 2000

(51) Int. Cl.[7] ..... H01Q 1/12

(52) U.S. Cl. ..... 248/534; 248/300; 248/237; 343/878

(58) Field of Search ..... 248/534, 535, 248/200, 300, 216.1, 237; 343/878, 880, 882, 888; D14/231

(56) References Cited

U.S. PATENT DOCUMENTS

| | | | | | |
|---|---|---|---|---|---|
| 4,067,151 | A | * | 1/1978 | Drakulic | 248/262 |
| 5,279,389 | A | * | 1/1994 | Crockett | 182/129 |
| 5,647,567 | A | * | 7/1997 | Pugh et al. | 248/237 |
| 5,816,465 | A | * | 10/1998 | Suzuki | 226/92 |
| D413,603 | S | * | 9/1999 | Inoue | 343/882 |
| 6,017,652 | A | * | 1/2000 | Schreib | 180/68.5 |
| 6,195,066 | B1 | * | 2/2001 | Pegues et al. | 248/237 |

FOREIGN PATENT DOCUMENTS

| | | | | |
|---|---|---|---|---|
| DE | 4227240 C1 | * | 3/1994 | B24D/15/02 |
| JP | 8-241743 | * | 8/1996 | H01R/9/09 |

* cited by examiner

*Primary Examiner*—Leslie A. Braun
*Assistant Examiner*—Jon Szumny

(57) ABSTRACT

The DSS Uni-Mount is a ¼" aluminum plate which is designed to mount a standard DSS (small dish) mounting arm to the gable end or hip edge of most residences or structures. This device virtually eliminates the need for roof penetrations in order to mount a DSS satellite dish. The top of the DSS Uni-Mount is machined at a roof angle of 5 & 12 and is designed for application to the gable end of a structure. It accommodates roof pitches from 4 & 12 thru 8 & 12. The bottom is cut at 90° to the sides thus enabling mounting to flat or hip portion of the roof line by inversion of the unit. A total of eight ⅜" diameter holes are drilled thru the Uni-Mount in strategic places to allow the installer to match the DSS mounting arm holes with the DSS Uni-Mount plate. Lag bolts and machine bolts are then screwed thru and to the DSS Uni-Mount in order to secure the DSS mounting arm to the gable or eaves of the roofline. The plate also accommodates the mounting of a dual grounding block, which enables electrical grounding of both the satellite antenna/mounting arm bracket and coax cable at a common junction point.

1 Claim, 3 Drawing Sheets

DSS UNI-MOUNT

CROSS REFERENCE TO RELATED APPLICATION

A through search on our part has concluded that no other inventions or patents, taken either singly or in combination, were found to describe the invention as claimed herein.

BACKGROUND OF INVENTION

1. Technical Field

This invention relates to a device for mounting a satellite antenna to the eave or gable end of a building.

2. Description of the Prior Art

Many supports for satellite antennas have been devised. However, a through search on our part has concluded that no other inventions or patents, taken either singly or in combination, were found to describe the invention as claimed herein.

3. Background

Increased satellite signal sensitivity in signal reception equipment has diminished. the requisite size of antenna dishes to presently a mere. eighteen to twenty inches in diameter. The C-Band satellite systems (6–16 feet or more in diameter) are now obsolete and has given way in favor of the new 18 inch–20 inch diameter satellite antennas. Because a smaller antenna profile translates into reduced wind and load stress, satellite antenna can now be mounted directly to a wall or roof of a typical residence. The weight of the small DSS satellite dish and mounting arm is typically only 9–11 lbs.

It is necessary for satellite installations located in the United States, for example, to have a clear line of sight to the southern sky without any type of obstructions. In order to obtain the correct and unobstructed line of sight as required, the installer is basically limited to three basic choices for installing the satellite dish to the structure. These are: (1) affixed to a chimney (2) mounted to a southern wall of the structure or (3) mounted to the top of a pitched roof The chimney mount is not an ideal mounting option because of its' unsightly appearance and the fact that many homes do not even have chimneys.

The wall mount to the southern end of a building is an acceptable means of mounting the satellite antenna to the structure; however, the problem with this mounting option is the most buildings have various obstructions in the way such as trees, shrubs and or other structures.

The roof mount is the least favorable option for both obvious and non-obvious reasons. When the satellite mounting arm is fastened to a roof, six to eight holes must be drilled thru the roofing material. Two of the eight holes are intended to be positioned over the roof rafter and secured by two inch lag screws and the other six lag screws are to be screwed thru the decking material located under the roofing material. Problems which confront an installer in this situation is the inability to accurately determine where the rafter is located underneath the roofing material. Even if the installer hits the rafter with a maximum of two lag screws (because of the design of the standard DSS mounting arm), the dish will tend to rock back and forth in high winds. and eventually would cause a breakdown of the roofing surface located under the DSS mounting arm and cause a leak in the roof. Each time a hole is drilled into the roof of a building a potential leak is formed. In addition, roofing materials consisting of clay tile, cedar shakes, or thin metal offer absolutely no option regarding the roof mount. Although the roof mount is by far the most discouraged of all mounting solutions according to all major DSS installation manuals, it is probably the most widely used of all options. This is because there is no viable solution for the DSS satellite installer.

In light of the problems listed above, the most advantageous mounting location for the small satellite dishes is on the eave or gable end of the building. The gable and hip area of a roofline provides a convenient means of attaching the antenna to the structure. Somewhere along the roofline a suitable place can normally be found to allow a clear line of sight to the satellite located in the sky. Due to the design of the standard DSS mounting bracket, it is virtually impossible to effectively mount the bracket to the gable end of a building or the hip end of a roof. Mounting to the gable end of a house, the original bracket is not rigid enough to support the satellite dish adequately, especially in high wind situations. The bottom part of the original DSS mounting bracket is left with no support. The eaves of rooflines are also not compatible with the standard DSS mounting arm because again the bracket is not rigid enough to support the weight of the satellite dish in high wind situations. Again the bottom part of the original DSS mounting bracket is left with no support. Using the eave or gable mount the installer would be able to better situate the satellite antenna closer to the utilities (i.e.: house ground, cable tap, etc.). The installer would also be able to situate the dish out of sight of the front of the house due to the many mounting points now available to the installer. The very small size and weight of the DSS satellite dish make the eave mount a very attractive mounting option. The rigidity of the gables and hip roof area of structures make the DSS Uni-Mount an ideal mounting solution for installers.

A BRIEF SUMMARY OF THE INVENTION

The DSS Uni-Mount was invented to provide a viable solution for the professional DSS installer. The DSS Uni-mount is a tested and proven device that enables rigid and professional mounting of a DSS satellite dish. The DSS Uni-Mount facilitates a means for a DSS satellite dish to be mounted without roof structure penetrations which, in turn, eliminates the possibility of water damage, and provides the installer with infinite attachment points along the roofline while maintaining proper line of sight with satellites aloft. The top of the DSS Uni-Mount is machined at a roof angle of 5 & 12 and is designed for application to the gable end of a structure. It accommodates roof pitches from 4 & 12 thru 8 & 12. The slope of the roof is determined by the vertical rise in inches for every twelve inch run. It is expressed with the rise mentioned first and the run mentioned second. The bottom is cut at 90° to the sides thus enabling mounting to the eaves or hip portion of the roof line by inversion of the unit. The unit also incorporates the ability to electrically ground the DSS equipment as required by the manufacturer and the National Electric Code (N.E.C.). The coax grounding block is affixed to the back side of the Uni-Mount using existing holes and small self tapping screws.

The satellite antenna is secured to a building by the following method.

Gable Roofs: (1) Place the DSS Uni-Mount (hereafter referred to as the "Plate") against the gable trim of the house. Level the Plate by placing a level on the side or bottom edge 18 of said item. Once the plate is level, take a pencil and mark the location of the mounting holes 14, 15, 16, & 21 as they line up with the gable end of the house. Remove the Plate and drill four 5/32" pilot holes into the gable of the house. (2) Using two 7/32" machine bolts and nuts, loosely affix the Original DSS Mounting arm to the plate using the lower holes 17&19. (3) Take the Original DSS mounting Bracket and Plate assembly up to the mounting location. Using 7/16" lag bolts that are 1½" long, bolt the assembly to the gable of the house using holes 14, 15, 16 and 21 making sure that the arm stays perpendicular to the ground. Conclude by tightening all bolts and screws.

With reference to FIG. 3; Hip Type Roofs: (1) Locate the roof rafter located behind the 1×6 fascia board 31 at the preferred location. This can be accomplished by locating the nail heads in the 1×6 fascia board or use an electronic stud finder. The nail heads indicate where the roof rafter is located. (2) Using the plate, invert said item so that the 90° end (opposite end from the gable cut) is butted up next to the roofline or decorative trim 33 (whichever is lower). (3) Position the plate making sure that the middle upper holes of the Uni-Mount 26 are in line with the roof rafter. (4) Mark the three upper hole locations 25,26&32 of the Uni-Mount and drill pilot holes using a 5/32 inch drill bit to accommodate the 5/16 inch lag bolts which will be used to secure the Uni-Mount and dish assembly to the structure. (5) Using 7/32" machine bolts and nuts, affix the original dish mounting arm to the plate using the lower holes 27&30 (6) Attach the Uni-Mount and dish mounting arm to the structure by inserting the 1½ inch lag bolts thru holes 25,26 and 32. Conclude by tightening all bolts and screws.

The installer may now proceed with final alignment and assembly instructions.

BRIEF DESCRIPTION OF THE SEVERAL VIEWS OF THE DRAWING

The accompanying drawing is incorporated into and forms a part of the specification to illustrate an example of the present invention. This drawing together with the description serves to explain the principles of the invention. The drawing is to be used only for the purpose of illustrating preferred and alternative examples of how the invention can be made and used and is not to be construed as limiting the invention to only the illustrated and described examples. The various advantages and features of the present invention will be apparent from a consideration of the drawing in which.

DETAILED DESCRIPTION OF THE INVENTION

The DSS Uni-Mount is designed to allow any standard DSS mounting arm to be mounted to the gable or eave of a residence, building, or structure anywhere along its roofline. The top of the DSS Uni-Mount is machined at a roof angle of 5 & 12 and is designed for application to the gable end of a structure. It accommodates roof pitches from 4 & 12 thru 8 & 12. The slope of the roof is determined by the vertical rise in inches for every horizontal twelve inch run. It is expressed with the rise mentioned first and the run mentioned second. The bottom is cut at 90° to the sides thus enabling mounting to flat or hip portion of the roof line by inversion of the unit.

Figure 1:
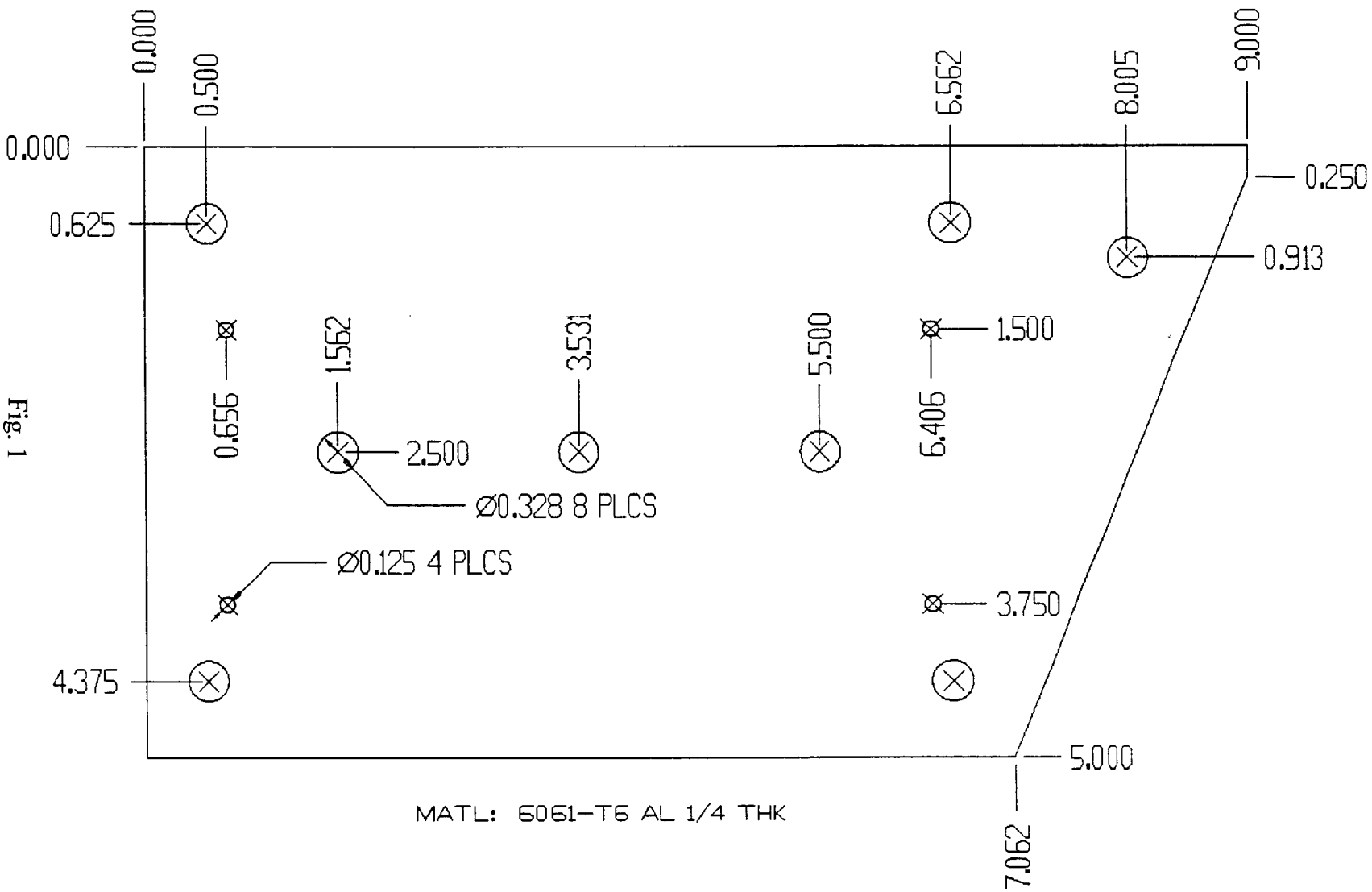
FIG. 1 is a frontal view of the DSS Uni-Mount Plate.
Figure 2:
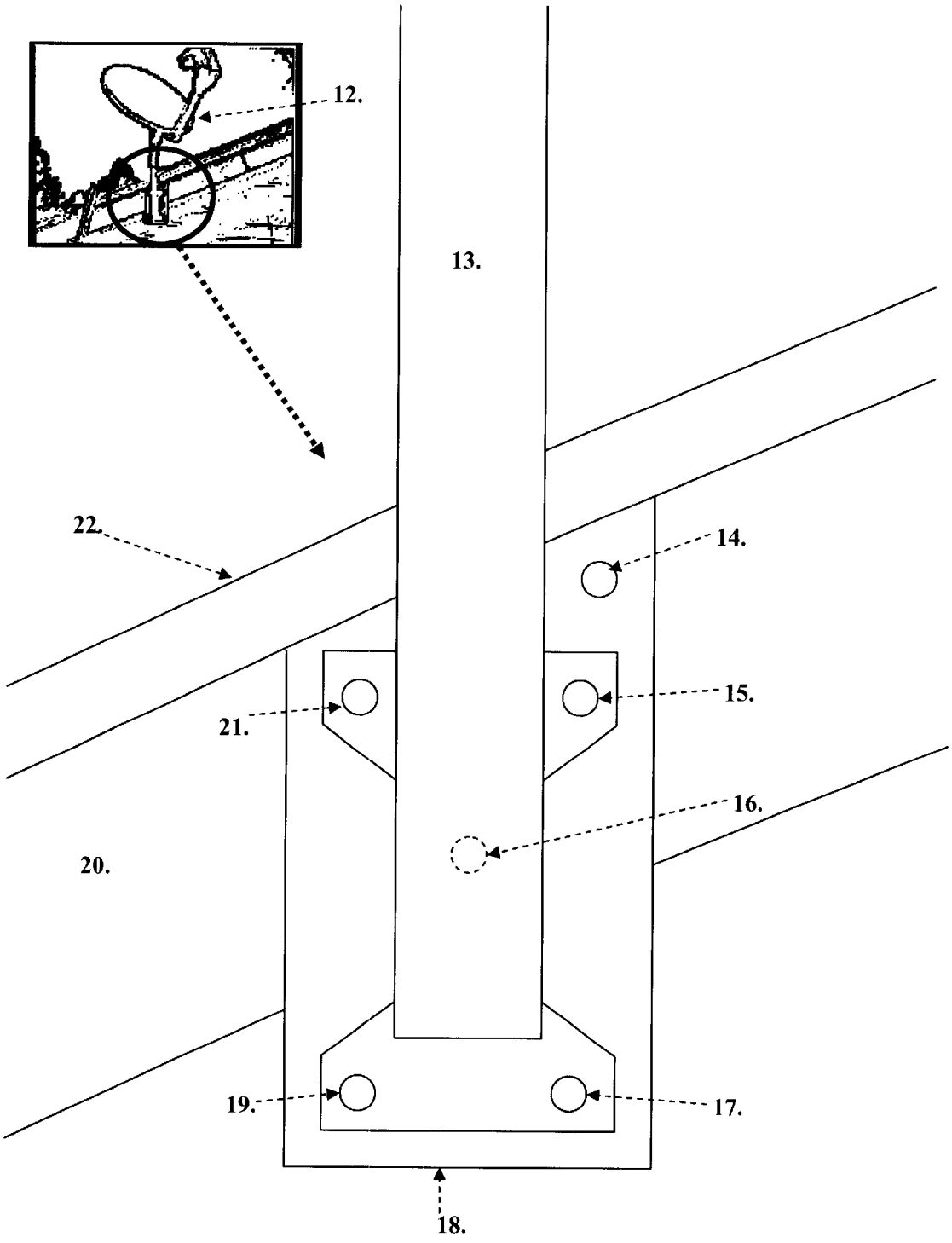
FIG. 2 depicts the DSS Uni-Mount mounting on a gable style roofline featuring an exploded view of the mounting bracket and mounting arm assembly

Installation of the unit would be as follows: Gable Style Roofs: With reference to FIG. 2; (1) Place the DSS Uni-Mount 18 (hereafter referred to as the "Plate") against the eave 20 of the house. Level the Plate by placing a level on the side or bottom edge of said item. Once the plate is level, take a pencil and mark the location of the mounting holes 14, 15, 16&21 as they line up with the eave of the house. Remove the Plate and drill four 5/32" pilot holes into the eave of the house. (2) Using two 7/32" machine bolts and nuts, loosely affix the Original DSS Mounting arm to the plate using the lower holes 17 and 19. (3) Take the Original DSS mounting Bracket and Plate assembly up to the mounting location. Using 7/16" lag bolts that are 1½" long, bolt the assembly to the eave of the house using holes 14, 15, 16 and 21. Conclude by tightening all hardware.

Figure 3:
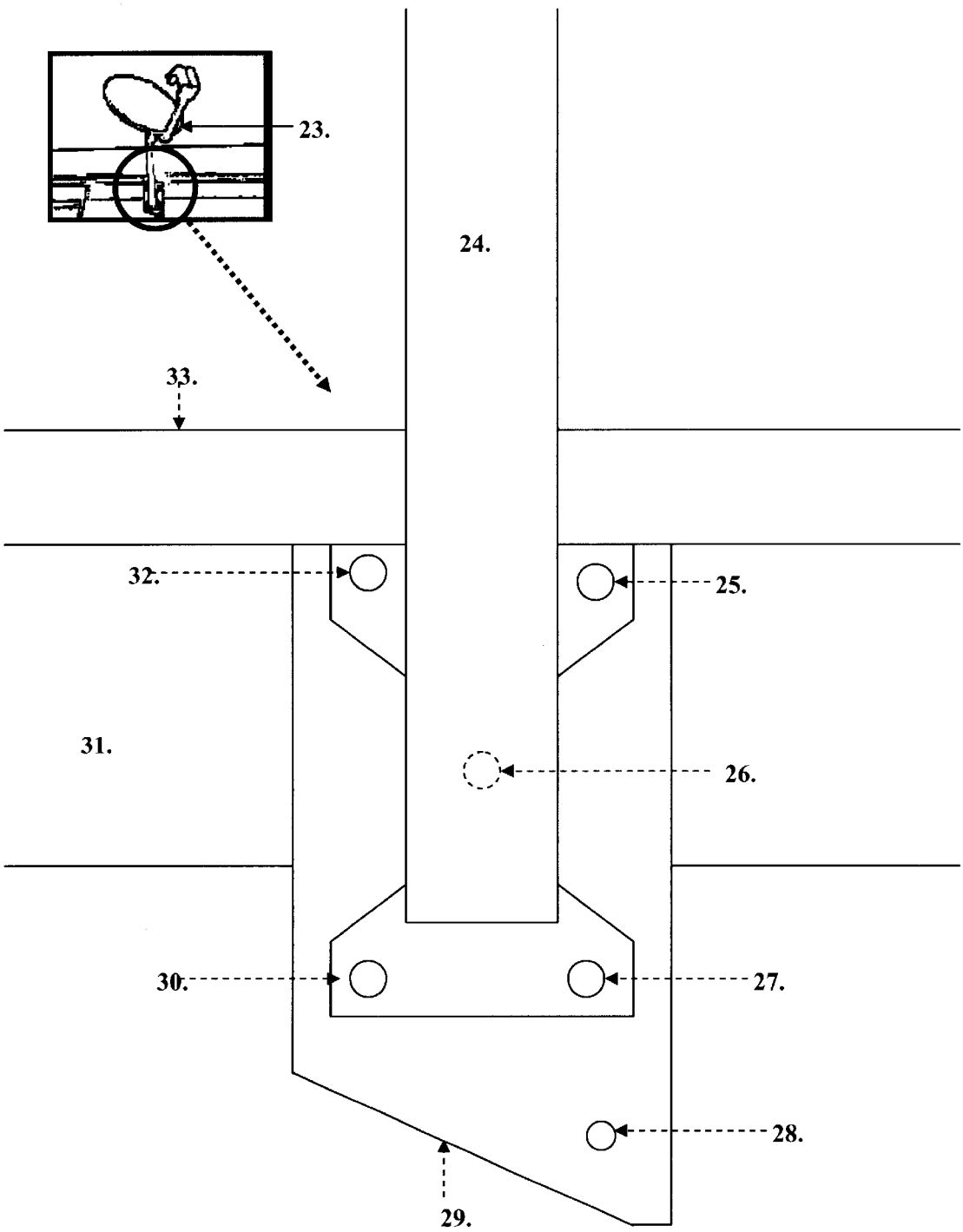
FIG. 3 depicts the DSS Uni-Mount mounted on a gable style roofline featuring an exploded view of the mounting bracket and mounting arm assembly.

With reference to FIG. 3; Hip Type Roofs: (1) Locate the roof rafter located behind the 1×6 fascia board 31 at the preferred location. This can be accomplished by locating the nail heads in the 1×6 fascia board or use an electronic stud finder. The nail heads indicate where the roof rafter is located. (2) Using the plate, invert said item so that the 90° end (opposite end from the gable cut) is butted up next to the roofline or decorative trim 33 (whichever is lower). (3) Position the plate making sure that the middle upper holes of the Uni-Mount 26 are in line with the roof rafter. (4) Mark the three upper hole locations 25,26&32 of the Uni-Mount and drill pilot holes using a 5/32 inch drill bit to accommodate the 5/16 inch lag bolts which will be used to secure the Uni-Mount and dish assembly to the structure. (5) Using 7/32" machine bolts and nuts, affix the original dish mounting arm to the plate using the lower holes 27&30 (6) Attach the Uni-Mount and dish mounting arm to the structure by inserting the 1½ inch lag bolts thru holes 25,26 and 32. Conclude by tightening all bolts and screws.

The plate is made of 6061 T-6 aircraft aluminum and is trapezoid in design with the longest side measuring approximately 9", the shorter side measuring approximately 7", and the width being 5". A total of eight ⅜", and four ⅛" diameter holes are drilled into the plate to allow an original DSS mounting arm bracket to line up with the bolt Pattern of the Plate. The plate also accommodates the mounting of a dual grounding block, which enables electrical grounding as required by the manufacturer. At present, a computer aided drafting machine, known as CAD, coupled with a machine lathe, and through a milling process produces a finished product. In the future, cost feasibility will necessitate the design and purchase of a dye that will be utilized by a hydraulic press for stamping the plate from flat 6061 T-6 aluminum stock. Although the present invention has been described and illustrated in detail, it is to be clearly understood that the same is by way of illustration and example only, and is not to be taken by way of limitation.

We claim:

1. A mounting plate for attaching onto the eave or gable end of a building a mounting arm bracket, said mounting arm bracket being secured to a first end of a pole, a second end of the pole being secured to a satellite dish, the mounting plate including a substantially flat trapezoidal shaped aluminum mounting plate comprising:

a) two substantially parallel side edges b) a bottom edge substantially perpendicular to the two parallel side edges;

c) a top edge substantially slanted with respect to the two parallel side edges;

d) a first series of four through holes extending from a front face to a back face of the mounting plate, each of the four through holes being positioned at the corners of an imaginary rectangle and being adapted to align with mounting holes of the mounting arm bracket;

e) a second series of through holes extending from the front face to the back face of the mounting plate, each adapted to receive a screw for securing the mounting plate onto the eave or gable end of the building;

whereby the mounting plate is adapted to be positioned on the building in two different orientations; in the first orientation the top slanted edge is adapted to be aligned with a corresponding slanted roofline, in the second orientation the bottom edge of the mounting plate is adapted to align with a corresponding level roofline;

whereby in both orientations the mounting arm bracket is adapted to be attached to the mounting plate substantially perpendicular to the ground;

whereby the pole is held in a position substantially perpendicular to the ground;

and whereby the top slanted edge is adapted to accommodate roof pitches from 4&12 through 8&12.

* * * * *